United States Patent [19]

Meyers et al.

[11] 4,136,871

[45] Jan. 30, 1979

[54] ROTARY TABLE BALL GAME

[75] Inventors: Michael R. Meyers, Trumbull, Conn.; Michael Langieri, Butler, N.J.; Calvin Cook, Erie, Pa.

[73] Assignee: Louis Marx & Co., Inc., Stamford, Conn.

[21] Appl. No.: 752,338

[22] Filed: Dec. 20, 1976

[51] Int. Cl.[2] ..... A63F 7/06

[52] U.S. Cl. ..... 273/85 A; 273/129 HA

[58] Field of Search ..... 273/85 A, 85 B, 85 E, 273/119 R, 119 A, 121 R, 121 A, 122 R, 122 A, 129 HA, 129 HB, 136 G, 134 E, 134 ES, 141 R, 141 A

[56] References Cited

U.S. PATENT DOCUMENTS

| | | | |
|---|---|---|---|
| 925,534 | 6/1909 | Tuthill et al. | 273/141 R |
| 1,377,364 | 5/1921 | Quinn | 273/119 R X |
| 2,382,328 | 8/1945 | Munro | 273/85 A |
| 3,425,696 | 2/1969 | Dockum | 273/136 G X |
| 3,817,523 | 6/1974 | Nolte | 273/85 A |
| 3,920,243 | 11/1975 | Santos | 273/85 A X |

FOREIGN PATENT DOCUMENTS

| | | | |
|---|---|---|---|
| 654918 | 2/1965 | Belgium | 273/85 A |
| 60324 | 4/1954 | France | 273/85 A |
| 1489138 | 6/1967 | France | 273/85 A |

*Primary Examiner*—Anton O. Oechsle

*Attorney, Agent, or Firm*—Blum, Moscovitz, Friedman & Kaplan

[57] ABSTRACT

A high speed rotary table ball board game is provided for playing hockey and soccer-like games. The playing surface has a goal at each end. A player controlled movable goalie blocks each goal. The game-piece is driven by curved rotary arms located on each side of the field. One handle is used to rotate all of said arms simultaneously. Rotary motion is imparted to the arms by means of a pawl and ratchet wheel mechanism operated by a player controlled handle. The playing surface is surrounded by sidewalls and a clear plastic cover to keep the gamepiece confined to the playing surface. The playing surface may be hinged at the center for carrying and storage.

23 Claims, 14 Drawing Figures

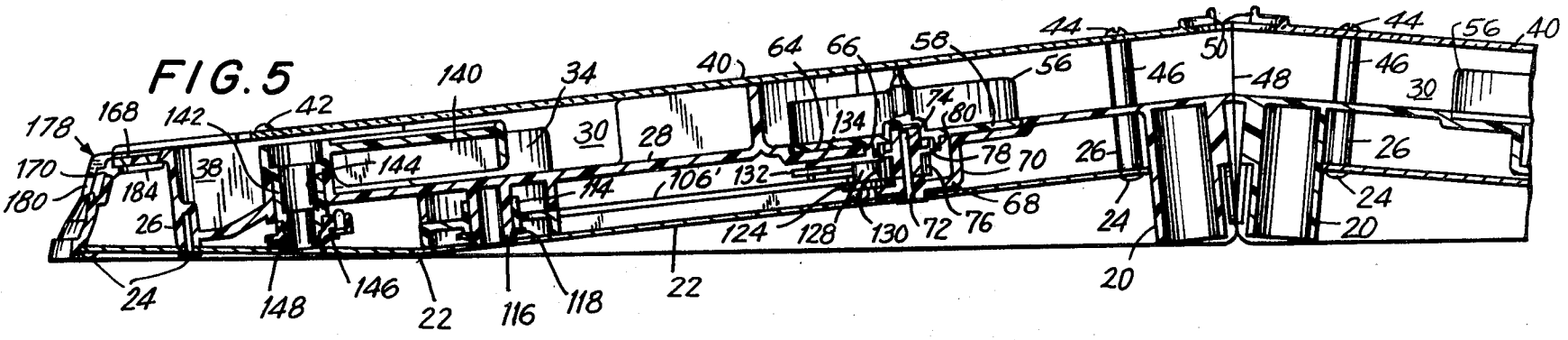
FIG. 5
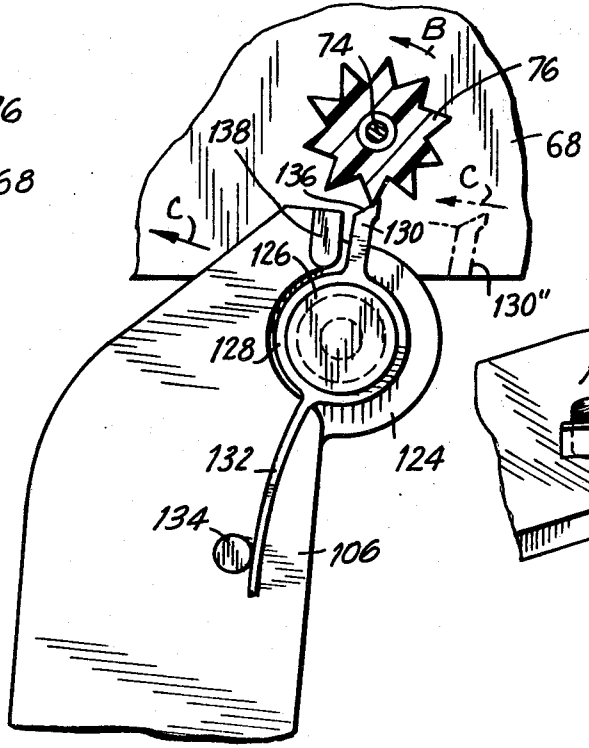
FIG. 6
FIG. 7
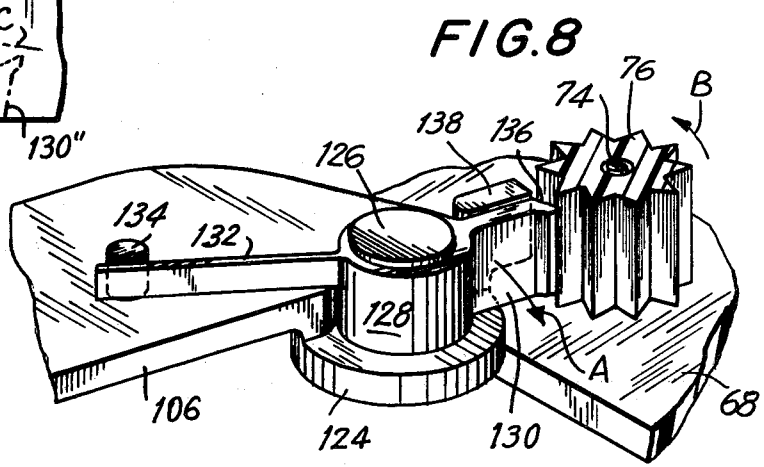
FIG. 8

ROTARY TABLE BALL GAME

BACKGROUND OF THE INVENTION

This invention relates generally to hockey or soccer-type board games in which each player has a number of flippers or spinners which are used to direct a game-piece, such as a ball, into the opposing player's goal. In prior games of this type, the game-piece was generally moved at a relatively low speed by the flippers or spinners. One of the reasons for the low speed of the game was the need to rotate each flipper or spinner by means of wrist action of the player. Another reason for the low speed of play is the fact that when a plurality of flippers or spinners was provided, each flipper or spinner was controlled by an individual handle. This necessitated movement of the player's hand from one control to another as the game-piece moved about the board. Additionally, the slow pace was necessitated by the means used to pivot or rotate the flippers or spinners. Usually the mechanism for moving the flippers or spinners did not provide for a continuous rotary action.

The requirement for individual control of each spinner or flipper necessitated a separate drive unit for each flipper. This requirement added undue mechanical complexity to the game and made such games relatively expensive.

SUMMARY OF THE INVENTION

Generally speaking in accordance with the invention, a high speed table ball game is provided wherein curved rotary arms which are used to propel the game-piece at high speed towards a target such as an opponent's goal. One operating handle may control all rotary arms for each player. The player operates the control handle by a squeezing motion. A second handle may operate a pivotable goalie member which is used to obstruct the player's goal.

The playing surface may be hinged at the center for carrying. The game may be arranged for competitive play by at least two players, each provided with curved rotary arms and goalie member. Where the game is arranged for two players, the game board may slope at the center towards a goal located at each end. The playing surface may be surrounded by side walls and a clear plastic cover to keep the game-piece confined to the playing surface.

Accordingly, it is an object of this invention to provide a hockey or soccer-like board game capable of high speed movement of the game-piece.

Another object of this invention is to provide a table game wherein only a single operating handle controls the operation of the game-piece projectors.

Yet another object of this invention is to provide a high speed hockey-like game which provides for movement of the rotary arms by means of a squeezing motion of the operating handle.

A further object of this invention is to provide a high-speed table ball game having a novel means of imparting rotary motion to the game-piece propellers.

Still another object of the invention is to provide a high speed hockey-like game that is relatively economical to manufacture.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 5 is a sectional view taken along lines 5—5 of FIG. 1.

FIGS. 6 and 7 are enlarged, fragmentary plan views of the rotary arm mechanism showing the toothed wheel and pawl at two positions thereof.

FIG. 8 is a perspective fragmentary view of the arm rotating mechanism.

DESCRIPTION OF THE PREFERRED EMBODIMENT

Figure 1:
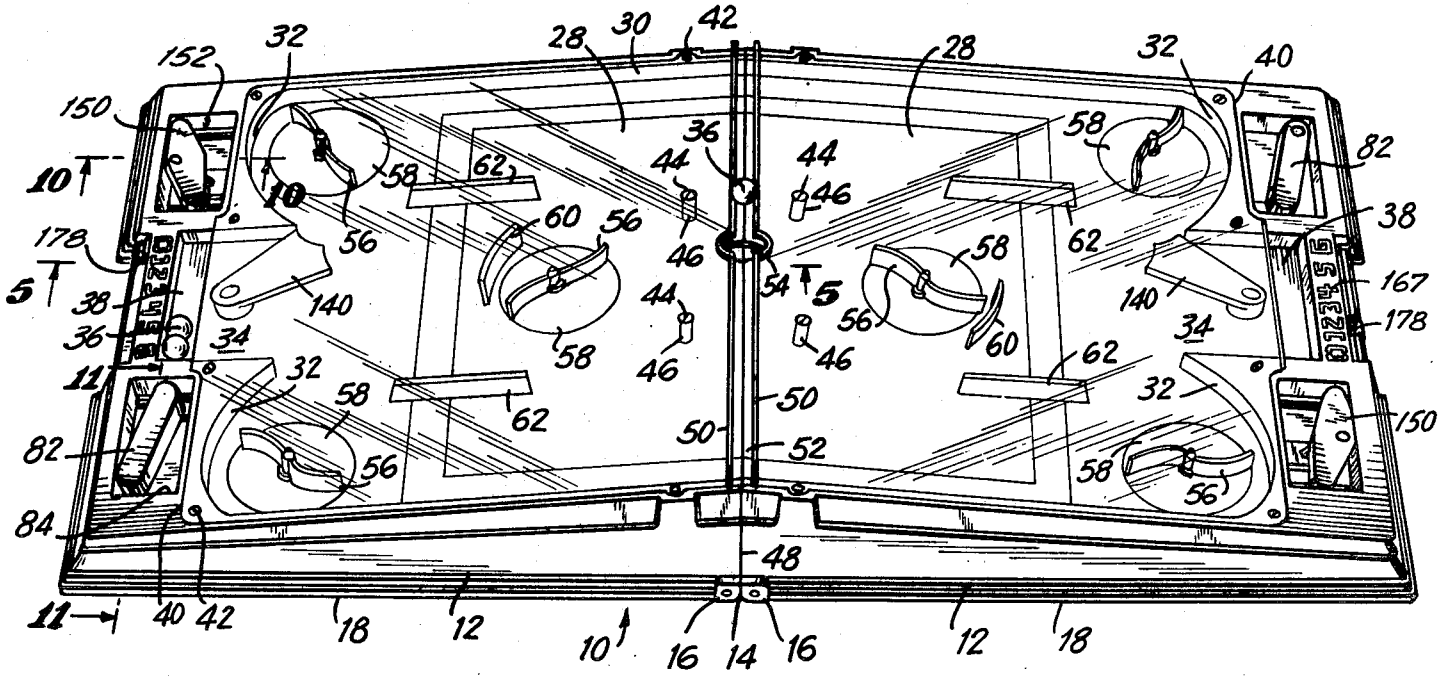
FIG. 1 is a top perspective view of the complete game board.
Figure 3:
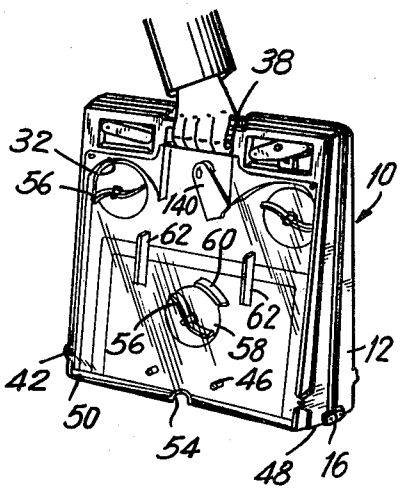
FIG. 3 shows a perspective view of the folded game board in carrying position.
Figure 2:
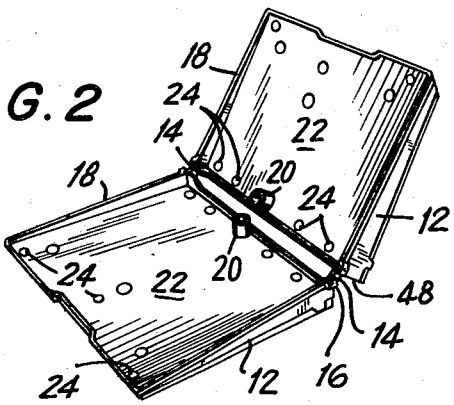
FIG. 2 is a perspective view of the underside of the completed game board showing the hinging thereof.

Referring now to FIGS. 1-3 and 5, the rotary table ball game 10 depicted includes two essentially identical game support members 12 joined together by hinge members 14 which are pivotably mounted to corner bracket 16 to permit the folding together of the two game support members 12 with the bottom periphery thereof in engagement for storage and carrying as more particularly shown in FIGS. 2 and 3. When opened, as shown in FIGS. 1 and 5, the game support members rest on a peripheral rim 18 and a downwardly projecting leg 20 centrally located along the inner periphery of each game support member 12. The underside of each game support member 12 is closed by a lower cover 22 secured by means of rivets 24 to projecting posts 26 integrally formed in each game support member 12. Each game support member is preferably molded from a plastic material as a unitary member. The central upper surface of each game support member 12 defines a playing surface 28 bordered by sidewalls 30 and a pair of spaced curved endwall portions 32. When the game 10 is in the open position as depicted in FIGS. 1 and 5, the respective playing surfaces 28 meet and communicate with each other to permit the passage of a game-piece such as one of balls 36 to pass therebetween. The respective game support members 12 are shaped so that the respective playing surfaces 28 are inclined from a highest point located at the intersection between the two playing surfaces 28 to a lowest point located in the respective goal regions 34. Each of goal regions 34 terminates in a trough 38 which serves to receive and retain balls 36 which pass through the respective goal regions 34. A transparent upper cover 40 overlies playing surface 28 and goal region 34 of each game support member and is received within a peripheral recess in the top surface of each game support member. The transparent upper covers 40 are retained in place by means of screws 42 projecting into corresponding apertures in the upper surface of game support member 12 and screws 44 which project into corresponding apertures in upstanding posts 46 which project from playing surface 28 in the inner central region thereof as more particularly depicted in FIG. 1. Transparent upper cover 40 terminates in the respective goal regions so as to leave exposed the respective troughs 38 to permit access to balls received therein. This construction also permits said troughs to serve as handles for carrying the game as more particularly depicted in FIG. 3, the inner facing sides 48 of the respective game support members being flat so that when folded, the game 10 can stand upright.

Each transparent upper cover 40 is formed with an upstanding projecting wall 50 which, together with the upstanding projecting wall of the other upper cover defines a ramp 52 extending laterally of the playing surface 28 and having an aperture 54 centrally located along said ramp and defined by hemispheric cut outs in the respective upper cover members. Both the ramp 52 and aperture 54 are dimensioned to receive a game-piece such as ball 36 to permit commencing of the game by propelling the ball along ramp 52 into aperture 54, the ball falling on to the intersection between the two playing surfaces 28 and randomly rolling down one or the other of said inclinded playing surfaces. Upper covers 40 may be shaped, in the area of ramp 52 to define an inclined ramp which either converges at or diverges from aperture 54.

Game-piece or ball 36 is propelled about the respective playing surfaces 28 by means of substantially S-shaped rotary arms 56, each mounted to project upwardly from a disc-shaped support member 58 for rotation therewith. Three such rotary arms 56 are provided on each playing surface 28, one essentially centrally located in the playing surface and one of the other two positioned adjacent to each curved endwall portion 32 for cooperation therewith. A curved partition wall 60 projects upwardly from each playing surface 28 in the vicinity of the centrally located rotary arm for cooperation therewith in projecting and deflecting ball 36. A pair of spaced substantially straight partition walls 62 are also provided extending longitudinally along the playing surface 28, one of said straight partition walls being positioned between the centrally located rotary arm and each of the rotary arms 58 positioned adjacent curved endwall portion 32. Each of the integrally formed rotary arms 56 and associated disc support 58 are mounted for free rotation as more particularly shown in FIG. 5. Specifically, a circular recess 64 is formed in playing surface 28 dimensioned to receive the correspondingly shaped disc support 58, each recess being formed with a central aperture 66. Said aperture is bridged by a bearing support 68 spaced from recess 64 and formed integrally therewith by means of connecting wall 70. Bearing support 68 is formed with an aperture 72 therethrough which receives and retains pin 74 which serves as a pivotable axis for rotary arm 56. A ratchet wheel 76 (see FIGS. 6–8) is mounted for free rotation on pin 74 and is joined to rotary arm 56 and disc support 58 by means of a non-circular hub 78 which couples with a corresponding non-circular socket 80. By this arrangement, rotary arm 56, disc support 58 and ratchet wheel 76 are freely rotatable as a unit about the axis defined by pin 74, all of said rotary arms being mounted in a like manner for free rotation. The substantially S-shape of the rotary arms 56 presents curved surfaces which serve to catch balls 36, as shown by way of example in FIG. 13, and to propel the balls towards the opponents goal at great speed when the rotary arms 56 are rotated in the counter clockwise direction as viewed in FIGS. 1 and 13.

Figure 11:
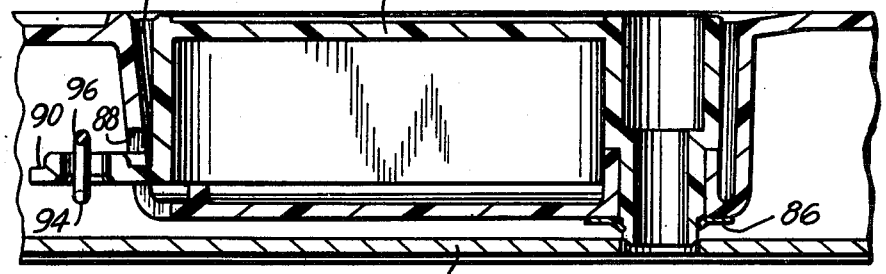
FIG. 11 is a sectional view taken along lines 11—11 of FIG. 1.
Figure 12:
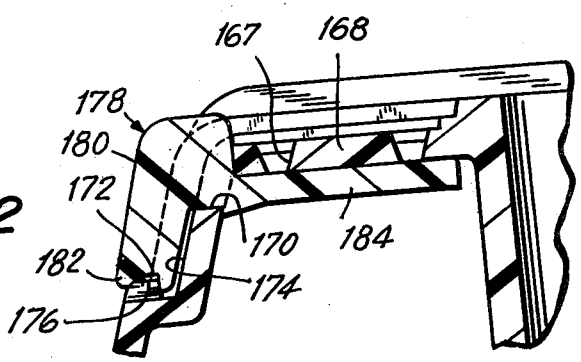
FIG. 12 is a sectional view taken along lines 12—12 of FIG. 4.

The three rotary arms 56 mounted on the playing surface 28 of each game support member 12 are coordinately driven by means of the displacement of a single rotary arm control 82 pivotably mounted in well 84 in the top surface of the respective game support members 12. The mechanism for rotating said rotary arms is more particularly depicted in FIGS. 4–9 and 11. Specifically, the rotary arm control 82 is secured to the bottom of well 84 by spring washer 86 (FIG. 11) which permits pivotable displacement of said rotary arm control. Well 84 is formed with a slot opening 88 in the side thereof through which extends a finger 90 which projects from rotary arm control 82. Finger 90 is joined to a three-armed rotary transmission member 92 by means of first rod 94 more particularly depicted in FIG. 9. First rod 94 has a first bent end 96 which passes through a slot 98 in finger 90 and a second bent end 100 which passes through an aperture 102 in post 104 formed integrally with arm 106 of said three-armed rotary transmission member 92. First rod 94 passes through an open slot 108 in a spring stop member 110 which is formed integral with game support member 12 on the underside of playing surface 28.

Figure 4:
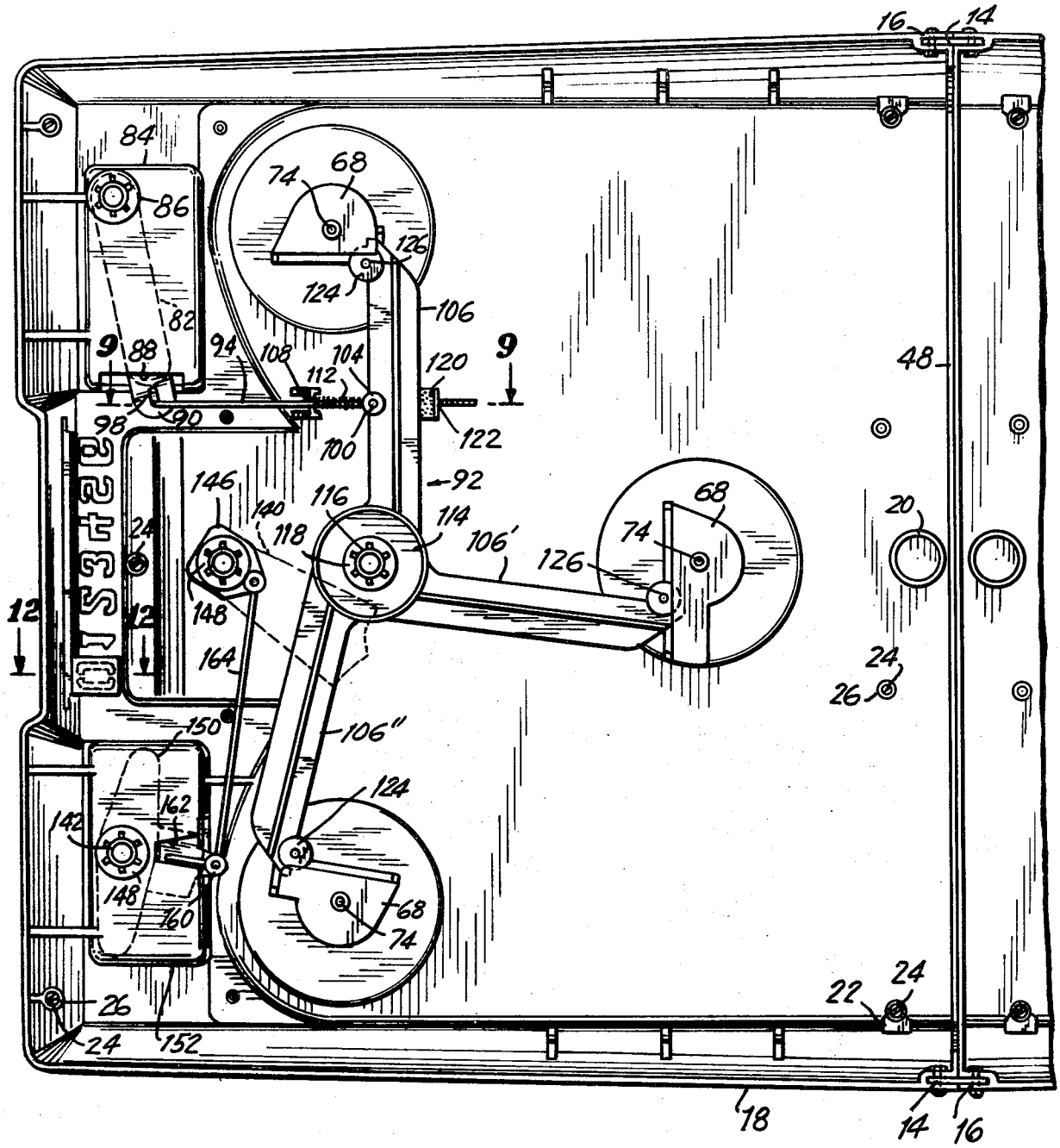
FIG. 4 is a plan view of the underside of the game board with the lower cover removed.
Figure 9:
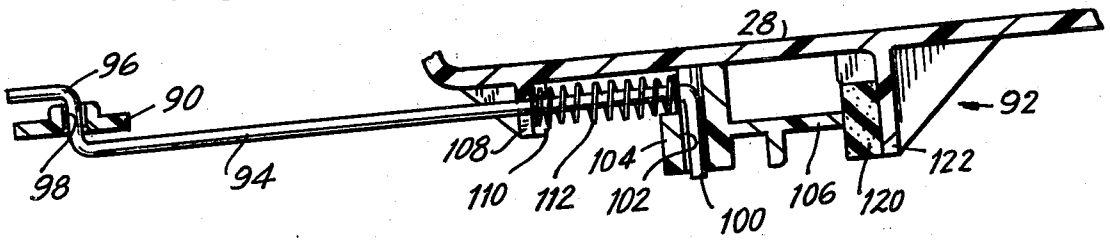
FIG. 9 is a sectional view taken along lines 9—9 of FIG. 4.

Rotary transmission member 92 is provided with a hub portion 114 mounted for free rotation about post 116 formed integrally with and projecting downwardly from game support member 12. Rotary transmission member 92 is held on post 116 by means of spring washer 118. Rotation of three-armed rotary transmission member 92 in the clockwise direction as viewed in FIG. 4 is limited by a resilient stopper member 120 secured to a flange 122 formed integrally with and projecting downwardly from game support member 12 (FIGS. 4 and 9). Coil spring 112 extends about first rod 94 between spring step member 110 and post 104. The spring normally biases arm 106 of rotary transmission member 92 against stopper member 120 and serves to return both the rotary transmission member and rotary arm control 82 to its initial position as viewed in FIGS. 1 and 4. Rotary transmission member 92 is provided with three arms 106, 106' and 106'', one of the arms being associated with each of rotary arms 56 for the rotational driving thereof in response to the displacement of rotary arm control 82 in a manner which will be more particularly described in conjunction with FIGS. 6–8.

Each of arms 106, 106' and 106'' is provided with a pawl support portion 124 at the end thereof which, together with rivet 126, rotationally supports a pawl member 128. Each pawl member includes a pawl 130 projecting from one side thereof and a spring finger 132 projecting from the other side thereof, said spring finger engaging against a pin 134 projecting from and formed integrally with the associated arm 106, 106', 106'' of rotary transmission member 92. When rotary transmission member 92 is rotated in the counter clockwise direction as viewed in FIG. 4 by displacement of rotary arm control 82 in the clockwise direction as viewed in FIG. 4, pawl 130 moves from the position 130' shown in phantom in FIG. 6 through the position shown in full lines in FIG. 6 in the direction of arrows A, at which position pawl 130 engages a tooth of ratchet wheel 76 to rotate said ratchet wheel and the associated rotary arm in the direction of arrow B as shown in FIG. 6. The counter clockwise rotation of rotary transmission member 92 as viewed in FIG. 4 carries pawl 130 to the position 130" shown in phantom in FIG. 7 on the opposite side of ratchet wheel 76. When rotary arm control 82 is released, the bias on spring 112 rotates rotary transmission member 92 in the clockwise direction as viewed in FIG. 4 to return same to its original rest position. The latter rotation is in the direction of arrows C of FIG. 7. Pawl 130 is provided with an inclined face 136 which engages and rides along the edge of the teeth of ratchet wheel 76 to momentarily rotate pawl member 128 in the clockwise direction as viewed in FIG. 7 against the force of spring finger 132 to permit the clearance of pawl 130 past ratchet wheel 76 during the return stroke in the direction of arrows C without interferring with the rotation of ratchet wheel 76 and the associated rotary arm in the direction of arrow B. In this manner, all of the rotary arms mounted on each game support member 12 are simultaneously rotated in the same direction by each displacement of the associated rotary arm control 82, a displacement requiring the use of only a single hand of the user. Repetitive displacement of rotary arm control 82 will maintain the rotation of the associated rotary arms 56 in the same direction, a direction calculated to hurl a ball 36 toward the opponents goal region. Rotation of pawl member 128 in the counter clockwise direction as viewed in FIGS. 6 and 7 during the driving stroke (direction of arrow A) is prevented by stop member 138 so that rotation of pawl member 128 about the axis defined by rivet 126 is permitted only during the return stroke and the pawl is immediately returned to a driving position by the bias on spring finger 132 cooperating with the associated pin 134.

Figure 10:
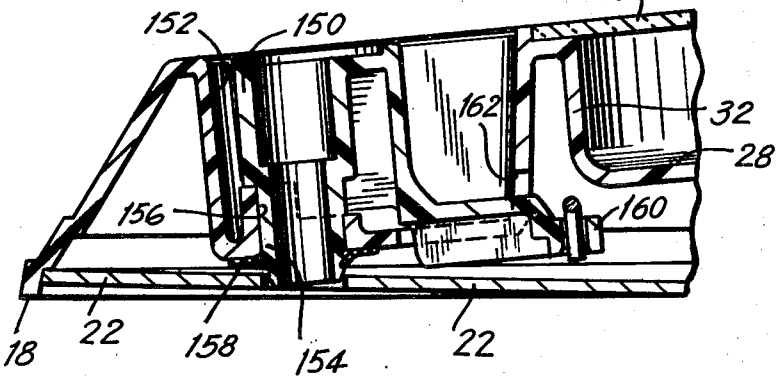
FIG. 10 is a sectional view taken along lines 10—10 of FIG. 1.
Figure 13:
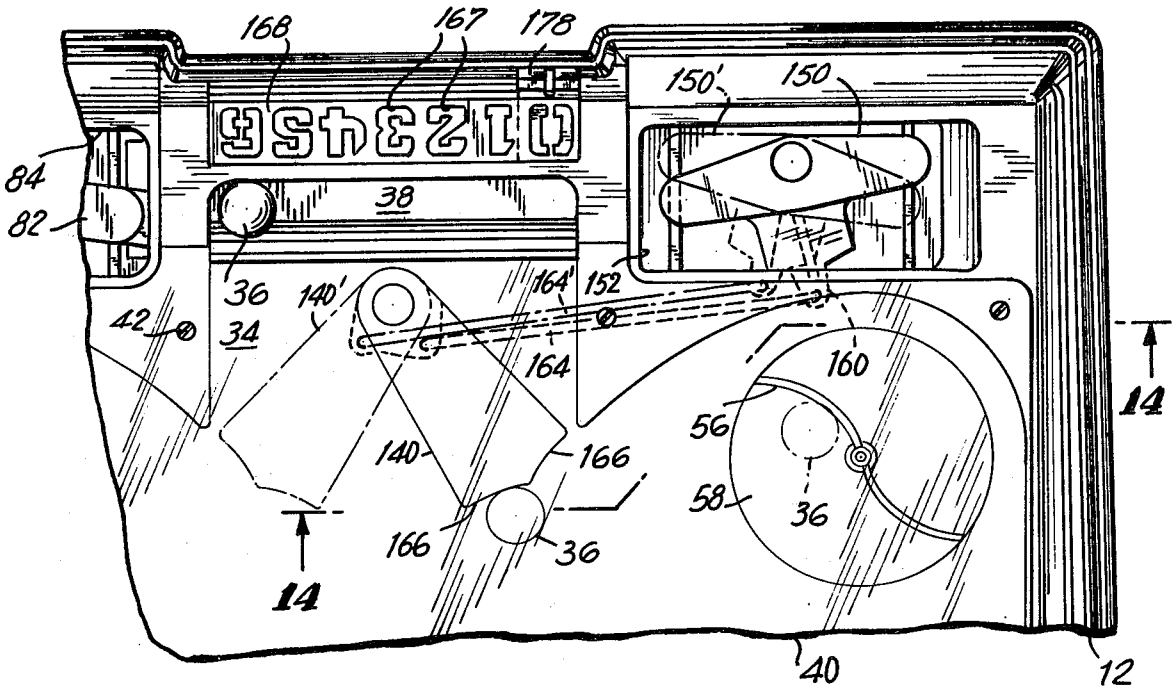
FIG. 13 is a top plan view of the mechanism for operating the goalie member.
Figure 14:
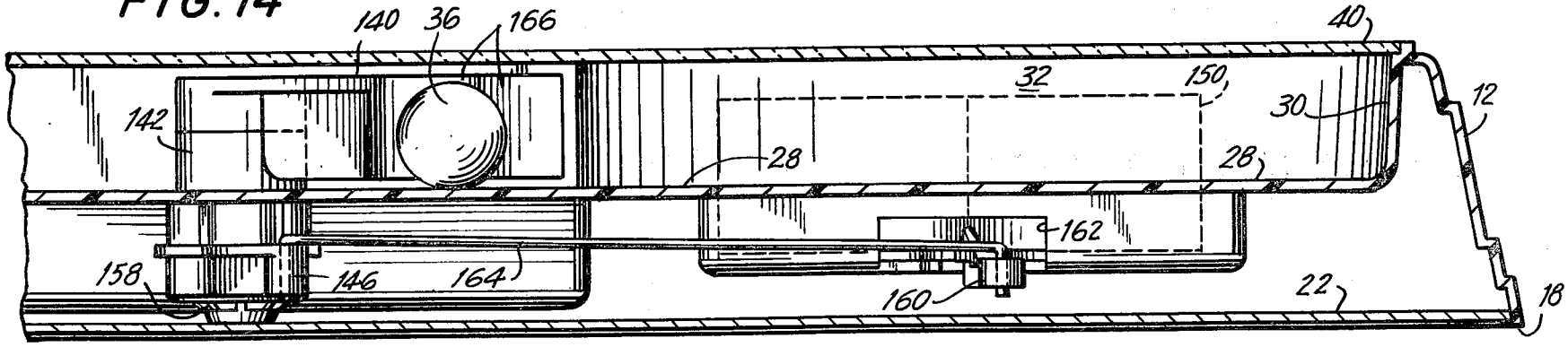
FIG. 14 is a sectional view taken along lines 14—14 of FIG. 13.

Each game support member 12 is provided with a single goalie member 140 pivotably mounted at one end thereof by means of axle portion 142 in an aperture 144 formed in goal region 34 of playing surface 28 of game support member 12 (FIG. 5). The lower portion of axle portion 142 is formed with a non-circular cross section for mating with a correspondingly formed aperture in goalie transmission member 146 for coordinate rotation of goalie transmission member 146 and goalie member 140. Goalie member 140 and goalie transmission member 146 are held in position for coordinate rotation by means of spring washer 148. The pivotable rotation of goalie member 140 is achieved by pivotable displacement of goalie control 150 which is pivotably mounted in a second well 152 located on the side of goal region 34 opposite to first well 86 in which rotary arm control 82 is located. Goalie control 150 is formed with a centrally located axle portion 154 which projects into aperture 156 in the bottom of well 152, said axle portion being retained in position by means of spring washer 158. Goalie control 150 is also formed with a projecting portion 160 which projects through an opening 162 in the bottom and side of well 152. Projecting portion 160 of goalie control 150 is coupled to goalie transmission member 146 by means of a second rod 164 (FIGS. 4, 10 and 13) which passes through respective apertures in said projecting portion 160 and goalie transmission member 146. Referring to FIG. 13, goalie control 150, second rod 164 and goalie member 140 are depicted in solid lines in one extreme position and in phantom lines represented by reference numerals 150', 164', and 140' in the other extreme position illustrating the ability of goalie member 140 to selectively block any region of the entrance to goal region 34 while permitting the passage of ball 36 thereby when the goalie member is not in a position to intercept same. Goalie member 140 is provided with a pair of curved ball catching and deflecting surfaces 166 at the end thereof for catching and deflecting a ball 36 projected thereagainst.

By the foregoing arrangement, each player can manipulate the goalie member 140 by his left hand and the three rotary arms by the right hand, thereby permitting full simultaneous use of all of the elements resulting in enhanced play value. Immediately behind ball-receiving trough 38 and intermediate wells 84 and 152 is a scoring arrangement consisting of the numerals 0 through 6 formed by cutting out regions 167 of scoring surface 168 of each game support member 12. Further, each game support member is formed with a laterally extending slot 170 immediately below and forward of scoring surface 168. Spaced below slot 170 is an upwardly projecting rib 172 spaced outwardly from the wall 174 in which slot 170 is formed. Rib 172 is formed with spaced notches 176, one notch being positioned centrally of each of the numerals formed by cut-out regions 167. Scoring is indicated by an indicating member 178 which rides in slot 170 and on rib 172. Indicating member 178 is formed with a manipulating portion 180 which permits grasping and lateral displacement of indicating member 178 so as to selectively place same in registration with each of the numerals formed by cut-out regions 167 in scoring surface 168. A downward projection 182 engages in notches 176 for positioning of the indicating member, the resilient material of which indicating member 178 is formed permitting the displacement of same from notch to notch. An essentially flat projecting portion 184 of indicating member 178 extends under cut-out regions 167, the lateral dimension of said flat projecting portion being substantially equal to the width of one numeral. In one embodiment, the indicating member 178 is formed of a material of a different color than that of scoring surface 168 so that the selected numeral is rendered visually distinguishable from the other numerals by reason of the fact that flat projecting portion 184 is visible through the cut-out regions 167.

While the rotary table ball game in accordance with the invention is depicted with three rotary arms, any number of rotary arms may be provided. Further, the rotary arm structure in accordance with the invention may be utilized with other types of games free of goals where the projection of a game-piece or ball from more than one point is desired. The essentially S-shape of the rotary arms 58 renders them usable in table ball games where each rotary arm is separately manipulated. While the embodiment of the table ball game depicted provides for two players, table ball games incorporating the features in accordance with the invention can be provided with only a single player or any number of players, depending on the orientation of the playing surface.

It will thus be seen that the objects set forth above, and those made apparent from the preceding description, are efficiently attained and, since certain changes may be made in the above construction, without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A table ball game for use with a game-piece comprising a playing surface; at least two arms for projecting said game-piece across said playing surface; axis means for rotatably mounting each said arm on said playing surface, each said arm extending radially from each said axis means across said playing surface, each said arm curving outwardly from said axis so that the concave portion of the curve faces in the direction of rotation, means for selectively rotating said arm about said axis in said direction, said rotating means including angularly manipulatable arm control means and means operatively coupling said arm control means and at least two axis means for coordinately rotating said arms in response to the manual manipulation of said arm control means, said coupling means including a pivotably mounted transmission member; means operatively connecting said arm control means and said transmission member for the selective pivoting of said transmission member in response to the manual displacement of said arm control means; ratchet wheel means operatively coupled to each of said axis means for rotation of said axis means in response to rotation of ratchet wheel means; and pawl means associated with each of said ratchet wheel means and coupled to said transmission member for displacement from a first point on one side of said ratchet wheel means past said ratchet wheel means to a point on the other side of said ratchet wheel means and back to said first point in response to the pivotable displacement of said transmission member, said ratchet wheel means and pawl means being adapted for rotation of said ratchet wheel means, and therefore the associated axis means and arm only during the displacement of said pawl means from said first point to said second point.

2. The table ball game as claimed in claim 1, wherein each of said pawl means are pivotably mounted on points spaced from the axis of pivoting of said transmission member in registration with the associated ratchet wheel means, said pawl means including a pawl projecting radially from the axis of pivoting of said pawl means and formed with an inclined face on the side thereof facing said first point, said pawl means being further formed with a radially extending spring finger, and including first stop means carried by said transmission member for engagement by said pawl to prevent pivotable displacement of said pawl toward said first point during displacement of said pawl means from said first point to said second point and second stop means for engagement by said spring finger to bias said spring finger when said pawl is pivotably displaced in the direction of said second point during the displacement of said pawl means from said second point to said first point, said biased spring finger returning said pawl to a position adjacent said first stop means after said pawl is past said ratchet wheel means during the displacement of said pawl means from said second to said first point.

3. The table ball game as claimed in claim 2, wherein said coupling means includes means biasing said transmission member and arm control means so that said transmission member normally positions said pawl means at said first point and returns said pawl means from said second point to said first point upon manual manipulation of said arm control means to pivot said transmission member to displace said pawl means from said first point to said second point.

4. The table ball game as claimed in claim 3, wherein said arm control means includes a pivotably mounted handle member, the means operatively connecting said handle member and said transmission member including rod means interconnecting said handle member and transmission member at points thereon spaced from their respective axes of pivoting, third stop means for limiting the pivotable displacement of said coupled transmission member and handle member in one direction, said bias means being positioned for biasing said transmission member against said third stop means.

5. The table ball game as claimed in claim 4, wherein said bias means includes a fixed stop member positioned to permit the displacement of said bar therepast and coil spring means extending about said bar intermediate said fixed stop member and said transmission member for compression in response to the manual pivoting of said handle means.

6. The table ball game as claimed in claim 2, including at least three of said axis means and associated arms, said axis means being distributed on said playing surface at positions radially spaced from the axis of pivoting of said transmission member and circumferentially spaced about said axis of pivoting relative to each other.

7. The table ball game as claimed in claim 6, including curved wall means projecting from said playing surface adjacent a portion of the path of each of said arms for cooperation with said arms in directing the trajectory of said game-piece.

8. A table ball game for use with a game-piece comprising a playing surface, at least two arms for projecting said game-piece across said playing surface; axis means for rotatably mounting each said arm on said playing surface, each said arm extending radially from each said axis means across said playing surface, each said arm curving outwardly from said axis so that the concave portion of the curve faces in the direction of rotation, means for selectively rotating each said arm about said axis in said direction, said rotating means including angularly manipulatable arm control means and means operatively coupling said arm control means and at least two axis means for coordinately rotating said arms in response to the manual manipulation of said arm control means, said playing surface being provided with two opposed goal regions each associated with the player, each of said goal regions including goal obstructing means and associated means for displacing said goal obstructing means, each of said goal regions having associated therewith first and second groups of said axis means and a means for coordinately rotating the axis means of each group independent of the other group, one of said groups being associated with each player, said game being symmetrical about a line transverse to the center of said playing surface, all of said axis means associated with one of said groups being on one side of said transverse center line and all of the axis means associated with the other of said group being positioned on the other side of said transverse center line, said playing surface being divided into two independent portions at said transverse center line, game support means for supporting each half of said playing surface and associated axis means, means for rotating said axis means, said game support means also supporting said means for rotating said axis means and said goal obstructing means and said means for displacing said goal obstructing means, means for hingedly connecting said game support members to position said two halves of said playing surface in registration at a first relative position of said game support members and to permit the folding together of said game support members so that said playing surfaces extend substantially parallel to each other and facing away from each other in a second relative position of said game support members, upstanding walls on the periphery of said playing surfaces except in said goal regions to define the periphery of said playing surfaces and the entrance to said goal regions, and transparent cover means substantially overlying each half of said playing surface and adapted to substantially mate when said game support members are in said first relative position with said playing surfaces in alignment.

9. A table ball game for use with a game-piece comprising a playing surface, at least two axis means rotatably mounted on said playing surface, an arm extending radially from each of said axis means across said playing surface for projecting said game-piece across said playing surface, manually manipulatable arm control means and means for operatively coupling said arm control means and said axis means for the coordinate selective rotation of said arms about their respective axis means in response to the manual manipulation of said arm control means, said coupling means including a pivotably mounted transmission member; means operatively connecting said arm control means and said transmission member for the selective pivoting of said transmission member in response to the manual displacement of said arm control means; ratchet wheel means operatively coupled to each of said axis means for rotation of said axis means in response to rotation of ratchet wheel means; and pawl means associated with each of said ratchet wheel means and coupled to said transmission member for displacement from a first point on one side of said ratchet wheel means past said ratchet wheel means to a point on the other side of said ratchet wheel means and back to said first point in response to the pivotable displacement of said transmission member, said ratchet wheel means and pawl means being adapted for rotation of said ratchet wheel means, and therefore the associated axis means and arm only during the displacement of said pawl means from said first point to said second point.

10. The table ball game as claimed in claim 9, wherein each of said pawl means are pivotably mounted on points spaced from the axis of pivoting of said transmission member in registration with the associated ratchet wheel means, said pawl means including a pawl projecting radially from the axis of pivoting of said pawl means and formed with an inclined face on the side thereof facing said first point, said pawl means being further formed with a radially extending spring finger, and including first stop means carried by said transmission member for engagement by said pawl to prevent pivotable displacement of said pawl toward said first point during displacement of said pawl means from said first point to said second point and second stop means for engagement by said spring finger to bias said spring finger when said pawl is pivotably displaced in the direction of said second point during the displacement of said pawl means from said second point to said first point, said biased spring finger returning said pawl to a position adjacent said first stop means after said pawl is past said ratchet wheel means during the displacement of said pawl means from said second to said first position.

11. The table ball game as claimed in claim 10, wherein said coupling means includes means biasing said transmission member and arm control means so that said transmission member normally positions said pawl means at said first point and returns said pawl means from said second point to said first point upon manual manipulation of said arm control means to pivot said transmission member to displace said pawl means from said first point to said second point.

12. The table ball game as claimed in claim 11, wherein said arm control means includes a pivotably mounted handle member, the means operatively connecting said handle member and said transmission member including rod means interconnecting said handle member and transmission member at points thereon spaced from their respective axes of pivoting, third stop means for limiting the pivotable displacement of said coupled transmission member and handle member in one direction, said bias means being positioned for biasing said transmission member against said third stop means.

13. The table ball game as claim in claim 12, wherein said bias means includes a fixed stop member positioned to permit the displacement of said bar therepast and coil spring means extending about said bar intermediate said fixed stop member and said transmission member for compression in response to the manual pivoting of said handle means.

14. The table ball game as claimed in claim 10, including at least three of said axis means and associated arms, said axis means being distributed on said playing surface at positions radially spaced from the axis of pivoting of said transmission member and circumferentially spaced about said axis of pivoting relative to each other.

15. The table ball game as claimed in claim 14, including curved wall means projecting from said playing surface adjacent a portion of the path of each of said arms for cooperation with said arms in directing the trajectory of said game-piece.

16. The table ball game as claimed in claim 9, including a goal region on at least one side of said playing surface, upstanding walls on the periphery of said playing surface except in said goal region to define the periphery of said playing surface and the entrance to said goal region, means for selectively obstructing a portion of said entrance to said goal region and means for selectively displacing said goal obstructing means to selectively obstruct different regions of the entrance of said goal region.

17. The table ball game as claimed in claim 16, wherein said goal obstructing means includes a pivotably mounted goalie member, said means for selectively displacing said goal obstructing means including handle means mounted for manual pivotable displacement and means connecting said handle means and said goalie member for displacement of said goalie member in response to the manual pivoting of said handle means.

18. The table ball game as claimed in claim 16, wherein said playing surface is provided with two opposed goal regions each associated with a player, each of said goal regions including goal obstructing means and associated means for displacing said goal obstructing means, and further, each of said goal regions having associated therewith first and second groups of said axis means and a means for coordinately rotating the axis means of each group independent of the other group, one of said groups being associated with each player.

19. The table ball game as claimed in claim 18, wherein said game is symmetrical about a line transverse to the center of said playing surface, all of said axis means associated with one of said groups being on one side of said transverse center line and all of the axis means associated with the other of said group being positioned on the other side of said transverse center line.

20. The table ball game as claimed in claim 19, wherein said playing surface is divided into two independent portions at said transverse center line, and including game support means for supporting each half of said playing surface and associated axis means, means for rotating said axis means, goal obstructing means and means for displacing said goal obstructing means; and further including means for hingedly connecting said game support members to position said two halves of said playing surface in registration at a first relative position of said game support members and to permit the folding together of said game support members so that said playing surfaces extend substantially parallel to each other and facing away from each other in a second relative position of said game support members.

21. The table ball game as claimed in claim 20, including transparent cover means substantially overlying each half of said playing surface and adapted to substantially mate when said game support members are in said first relative position with the playing surfaces in alignment.

22. The table ball game as claimed in claim 9, wherein each said arm includes first and second curved portions projecting radially from opposite sides of said axis means and shaped so that the concave portion of each curve faces in the direction of rotation to define a generally S-shape.

23. A table ball game for use with a game-piece comprising a pair of game support members, each of said game support members having an upper surface defining one-half of a playing surface terminating along a mating edge, the respective playing surfaces of each of said game support members being in alignment when the respective mating edges are in alignment; upstanding peripheral walls substantially surrounding each half of said playing surface except in the region of said mating edge; means for manipulating a game-piece on said playing surface mounted on each of said game support members, and means for manipulating said game-piece on each of said game support members being independent of the means for manipulating said game-piece on the other of said game support members; hinge means joining said game support members permitting the pivotable relative displacement of said game support members between a first position at which said playing surface halves are in alignment and a second position at which said playing surface halves are facing in opposite directions and are substantially parallel with each other, and transparent cover means substantially overlying each half of said playing surface and adapted to substantially mate when said game support members are in said first relative position with the playing surfaces in alignment.

* * * * *